US007187355B2

(12) United States Patent
Tam et al.

(10) Patent No.: US 7,187,355 B2
(45) Date of Patent: Mar. 6, 2007

(54) DISPLAY DEVICE, METHOD OF DRIVING A DISPLAY DEVICE, ELECTRONIC APPARATUS

(75) Inventors: Simon Tam, Cambridge (GB); Richard Friend, Cambridge (GB)

(73) Assignee: Seiko Epson Corporation, Tokyo (JP)

( * ) Notice: Subject to any disclaimer, the term of this patent is extended or adjusted under 35 U.S.C. 154(b) by 191 days.

(21) Appl. No.: 10/148,136

(22) PCT Filed: Sep. 28, 2001

(86) PCT No.: PCT/GB01/04376

§ 371 (c)(1),
(2), (4) Date: Aug. 1, 2002

(87) PCT Pub. No.: WO02/27700

PCT Pub. Date: Apr. 4, 2002

(65) Prior Publication Data

US 2003/0030629 A1 Feb. 13, 2003

(30) Foreign Application Priority Data

Sep. 28, 2000 (GB) ..... 0023787.5

(51) Int. Cl.
*G09G 3/22* (2006.01)
*G09G 3/30* (2006.01)

(52) U.S. Cl. ..... 345/98; 345/76; 345/82

(58) Field of Classification Search ..... 345/76–104, 345/204–214; 315/169.01, 169.03, 169.1, 315/169.3

See application file for complete search history.

(56) References Cited

U.S. PATENT DOCUMENTS 5,184,114 A 2/1993 Brown
5,721,563 A * 2/1998 Memida ..... 345/98

(Continued)

FOREIGN PATENT DOCUMENTS

EP 0 953 959 A2 11/1999
EP 1017038 12/1999

(Continued)

*Primary Examiner*—Bipin Shalwala
*Assistant Examiner*—David L. Lewis
(74) *Attorney, Agent, or Firm*—Oliff & Berridge, PLC

(57) ABSTRACT

A display device comprising a driver circuit which modulates the duty cycle of the on-state of a pixel during a frame period. Preferably the driver circuit comprises a comparator and more preferably the comparator is formed of thin film transistors constituting a differential pair and an inverter. Also provided is a method of driving a display device comprising the step of modulating the duty cycle of the on-state of a pixel during a frame period. Beneficially the display device is an organic electroluminescent active matrix display device.

20 Claims, 8 Drawing Sheets

U.S. PATENT DOCUMENTS

| | | | | |
|---|---|---|---|---|
| 5,977,940 | A * | 11/1999 | Akiyama et al. | 345/92 |
| 5,977,942 | A | 11/1999 | Walker et al. | |
| 6,023,259 | A | 2/2000 | Howard et al. | |
| 6,307,322 | B1 * | 10/2001 | Dawson et al. | 345/76 |
| 6,525,709 | B1 * | 2/2003 | O'Callaghan | 345/98 |
| 6,590,549 | B1 * | 7/2003 | Marshall | 345/84 |
| 6,753,834 | B2 * | 6/2004 | Mikami et al. | 345/90 |
| 2002/0047817 | A1 * | 4/2002 | Tam | 345/76 |
| 2002/0140659 | A1 * | 10/2002 | Mikami et al. | 345/90 |
| 2003/0142048 | A1 * | 7/2003 | Nishitani et al. | 345/82 |

FOREIGN PATENT DOCUMENTS

| | | |
|---|---|---|
| JP | A 3-37622 | 2/1991 |
| JP | A 2000-235370 | 8/2000 |
| KR | 1990-13938 U | 7/1990 |
| WO | WO 98/33165 | 7/1998 |
| WO | WO 99/48983 | 9/1999 |

* cited by examiner

DISPLAY DEVICE, METHOD OF DRIVING A DISPLAY DEVICE, ELECTRONIC APPARATUS

The present invention relates to display devices and in particular to improving the display quality thereof. The invention also relates to a method and an electronic apparatus.

One example of a display device to which the present invention relates is an organic electroluminescent display device. Organic electroluminescent devices (OELDs) comprise a layer (active layer) of organic light emitting material, often a light emitting polymer, sandwiched between two electrodes which are used to pass a current through the active material. The device essentially behaves like a diode and the intensity of light emission is a function of the forward bias current which is applied. The devices are good candidates for the fabrication of display panels.

A basic requirement for a display panel is an ability to display good quality graphical images. This is dependent upon the ability of the individual pixels to generate a range of brightness intensity. The image quality improves as the number of gray scales increases. The conventionally used standard is 3×8 bit colour, equivalent to 256 gray scales per colour. This standard is used in many current day applications.

Various methods of generating gray scales with an analog driving circuit have been proposed for OELD displays. The conventional technique is to drive the OELD with a voltage dependent current and this has allowed the implementation of active matrix OELD displays. A typical arrangement is illustrated in FIG. 1 hereof.

As shown in FIG. 1, when transistor $T_1$ is selected (by voltage $V_{sel}$) it turns on and the data voltage ($V_{dat}$) is transferred to the gate of transistor $T_2$. Assuming $T_2$ is biased in the saturation region, the data voltage $V_{dat}$ is converted into current, which drives the OELD to the required brightness intensity.

The variation of threshold voltages of the transistors is, however, a very significant problem in the practical implementation of the above described display panels. Another significant problem is the high power consumption of these circuits.

An alternative method of providing gray scaling is to use an area dithering technique in which each pixel is divided in to a number of sub-pixels, preferably with binary weighted areas. Each sub-pixel is driven either fully on or fully off. Thus a digital driver can be used and power consumption reduced. However, this technique has the disadvantage that the panel size is increased (because each pixel is replaced by a number of sub-pixels and, in the limit, each sub-pixel is the same size as a conventional pixel) and also there is a large increase in the number of signal lines required (because of the need to address each sub-pixel).

Against this background, it is an object of the present invention to provide a display device with good gray scale capabilities which mitigates the above mentioned disadvantages.

According to the present invention there is provided a display device comprising a driver circuit which modulates the duty cycle of the on-state of a pixel during a frame period.

Thus, the present invention provides pulse width modulation of the on-period of a pixel and the integrating function of the human eye perceives this as modulation of the intensity of the emitted light. Modulation of the on-period is in stark contrast to the conventional control of brightness, ie control of the instantaneous amplitude of the current supplied.

Embodiments of the present invention will now be described in more detail by way of further example only and with reference to the accompanying drawings, in which.

Figure 1:
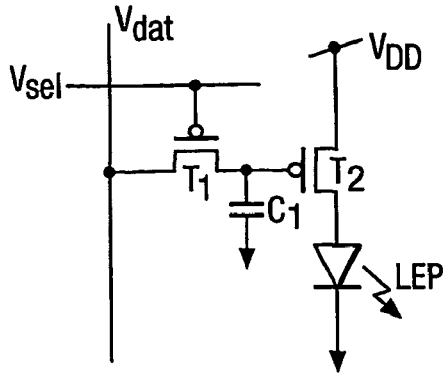
FIG. 1 is a circuit diagram of a conventional pixel level driver in an OELD display panel.
Figure 2:
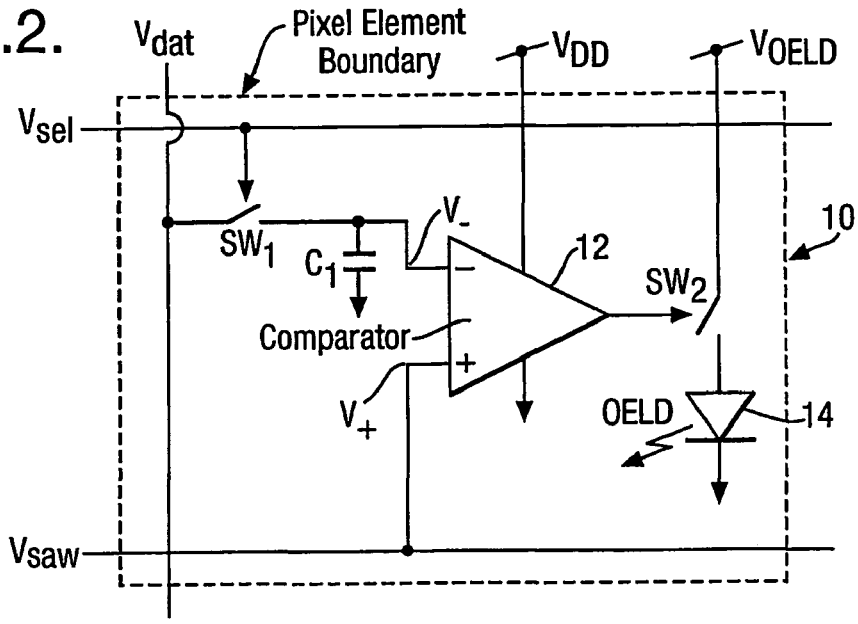
FIG. 2 is a circuit diagram of a pixel level driver in an OELD display panel, according to one embodiment of the present invention.
Figure 13:
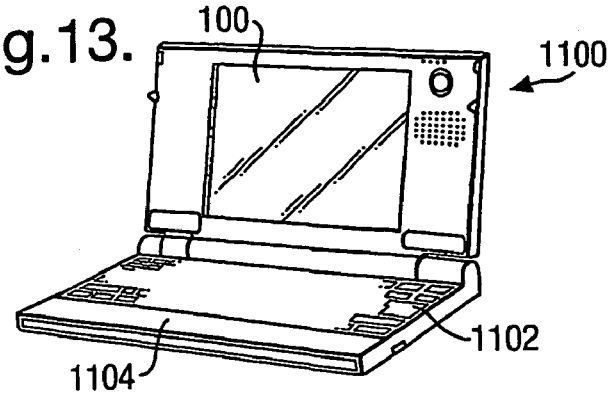
Figure 14:
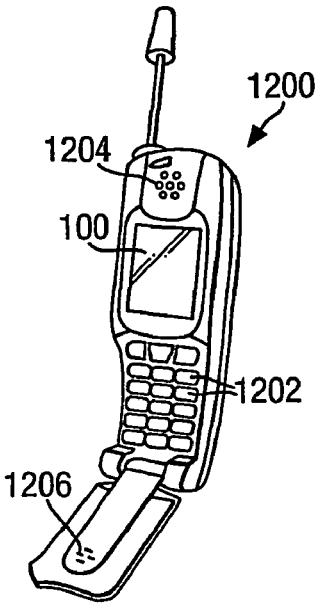
Figure 15:
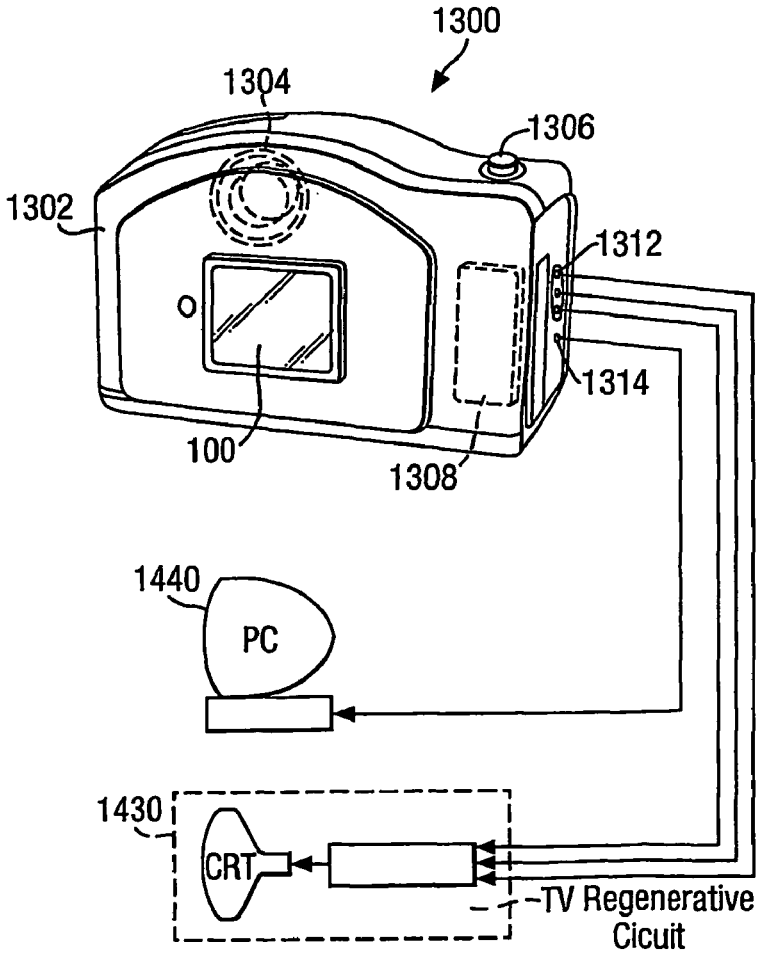

FIG. 13 is a schematic view of a mobile personal computer incorporating a display device having a pixel driver according to the present invention, FIG. 14 is a schematic view of a mobile telephone incorporating a display device having a pixel driver according to the present invention, and FIG. 15 is a schematic view of a digital camera incorporating a display device having a pixel driver according to the present invention, A description will first be given of the pixel level configuration according to one embodiment of the present invention. Thus, FIG. 2 is a circuit diagram of an individual pixel 10 within an active matrix OELD display panel. The circuit is implemented using polysilicon TFT components and comprises an MOS-input comparator 12 and two pass-gates, $SW_1$ and $SW_2$. The use of pass-gates avoids so-called "feed-through", i.e. coupling with other circuit voltages. The inverting input (+) of the comparator 12 is connected to a waveform source $V_{saw}$. The non-inverting input (−) is connected to a storage capacitor $C_1$ and a pass-gate $SW_1$. The pass-gate $SW_1$ is controlled by a waveform $V_{sel}$. The output of the comparator is connected to a pass-gate $SW_2$. Pass-gate $SW_2$ controls the current flowing in to the organic light emitting element 14. By applying a time varying signal to $V_{saw}$, the light emitting element 14 is switched on for a period depending on the value of the data voltage $V_{dat}$ which is applied to the other side of pass-gate $SW_1$ compared to the capacitor $C_1$ and the comparator 12.

In a line-at-a-time driving scheme, $V_{sel}$ sets the state of the pass-gate $SW_1$ of the pixel elements on the same row. When pass-gate $SW_1$ is closed, the data voltage $V_{dat}$ is transferred to the inverting input of the comparator 12 and to the capacitor $C_1$. Then, when pass-gate $SW_1$ is opened the data voltage is memorised by capacitor $C_1$. The waveform $V_{saw}$ is then initiated. When the voltage, $V_+$, at the inverting input of the comparator 12 is less than the voltage, $V_-$, at the non-inverting input thereof, the comparator outputs a LO signal which puts the light emitting element 14 in to the on-state. When the voltage, $V_+$, at the inverting input of the comparator 12 is greater than the voltage, V−, at the non-inverting input thereof, the comparator outputs a HI signal which puts the light emitting element 14 in to the off-state. As a result the data voltage stored by the capacitor $C_1$ modulates the duration for which the light emitting element 14 remains in the on-state during a frame period.

The frame period might typically be 20 mS and with the response time of the light emitting element 14 being of the order of nano-seconds, the speed of the polysilicon TFTs and any stray capacitance become the limiting factors in operation of the driving scheme. That is, exceptionally effective switching can be obtained.

In the circuit illustrated in FIG. 2, a common operating voltage $V_{OELD}$ is used for all OELD pixels of the same type. The voltage $V_{OELD}$ is set externally and is independent of the supply voltage $V_{DD}$ of the driving circuit. This significantly increases the flexibility of controlling the bias conditions for the OELDs.

A description will now be given of the detailed considerations which apply to the practical implementation of the comparator 12 used in the circuit of FIG. 2.

Since a separate comparator is provided for each pixel, the circuit area and power consumption of the comparator should be kept as low as possible. Further, in order to achieve a high number of gray scales, the comparator must be able to distinguish a small difference in input voltages. For example, if it is desired to implement 256 gray scales with a voltage swing of 0V to 5V then clearly something of the order of $\Delta V=19.5$ mV is appropriate. Thus switching must be very fast but, from the previous discussion, it is well within the ability of the described circuit.

Figure 3:
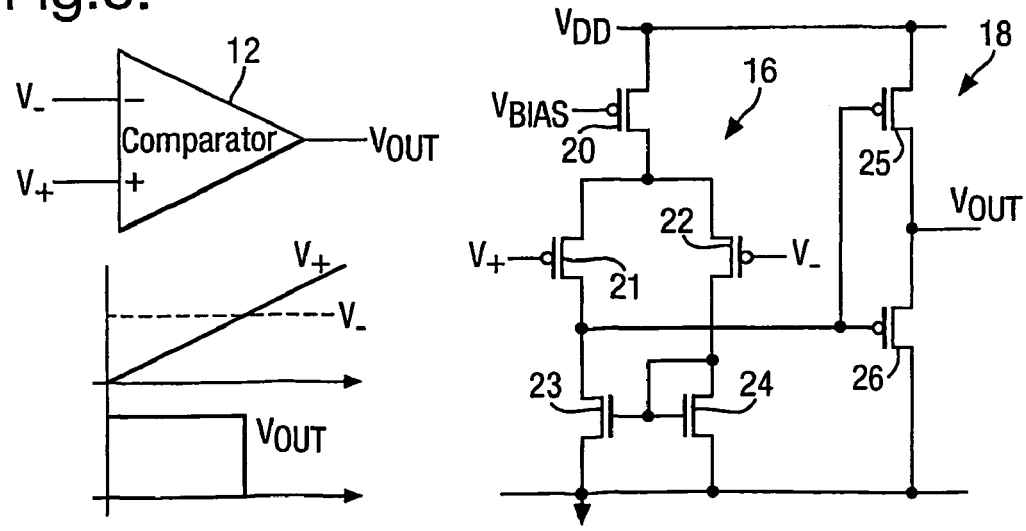
FIG. 3 illustrates a detailed circuit diagram and operating waveforms for an implementation of the comparator shown in the circuit of FIG. 2.

A detailed circuit diagram of one implementation of the comparator 12 of FIG. 2 is illustrated in FIG. 3. The circuit of FIG. 3 comprises two stages: a CMOS differential amplifier 16, and a CMOS inverter 18. The CMOS inverter 18 turns the pass-gate $SW_2$ fully on or fully off very quickly. For level shifting purposes the power supply of the inverter stage 18 can be different from that of the differential stage 16.

The differential stage 16 comprises the drain-source series connection circuit of transistors 20, 21 and 23 connected between the $V_{DD}$ rail and ground, together with the similarly connected circuit of transistors 20, 22 and 24, wherein transistors 22 and 24 are connected in parallel with transistors 21 and 23. The respective gates of transistors 21 and 22 provide the two input terminals (+), (−) of the comparator 12, whereas the gate of transistor 20 receives a bias voltage $V_{bias}$. The output stage 18 comprises two transistors, 25 and 26, which are source-drain series connected between the $V_{DD}$ rail and ground. The output $V_{out}$ of the comparator is taken from the connection between the transistors 25 and 26 and the gates thereof receive there input from the junction between transistors 21 and 23.

The circuit illustrated in FIG. 3 uses seven TFTs. Using a respective TFT for $SW_1$ and $SW_2$ brings the total per pixel to nine.

A description will now be given of various aspects of implementing a display panel incorporating the above described embodiment of pixel level circuitry.

Figure 4A:
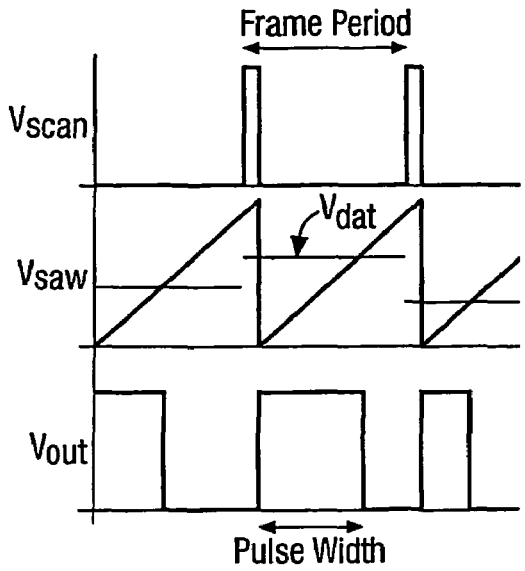
FIG. 4 illustrates driving waveforms in the circuit of FIG. 2.
Figure 4B:
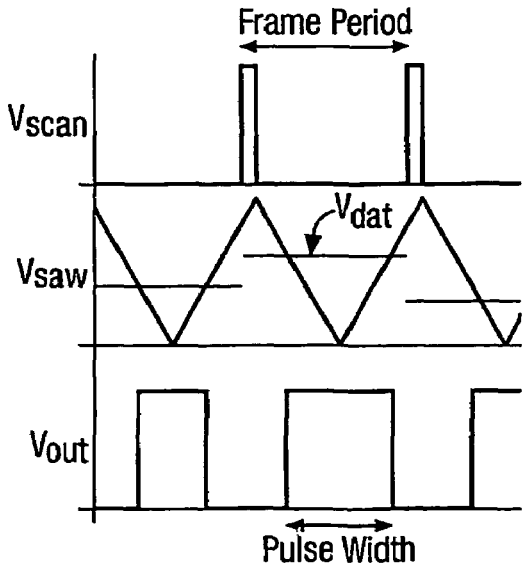

FIG. 4 illustrates waveforms which can be used with the circuit of FIG. 2. FIG. 4 comprise two diagrams, (a) and (b), in which the waveforms $V_{scan}$, $V_{saw}$ and $V_{out}$ are shown. $V_{out}$ is the driving pulse applied to the OELD. FIGS. 4(*a*) and (*b*) differ in the shape of the waveform used for $V_{saw}$. In FIG. 4(*a*) the waveform of $V_{saw}$ is a sawtooth whereas in FIG. 4(*b*) the waveform of $V_{saw}$ is triangular. Using the sawtooth waveform of FIG. 4(*a*) the output pulse always starts at the beginning of each frame. Thus the sawtooth waveform of FIG. 4(*a*) provides a linear gray scale, as it provides a reference time point for the eye to start integrating for each frame. For the triangular waveform of FIG. 4(*b*) the centre of the output pulse always occurs at mid-cycle.

Basically all pixels in the same row of the matrix share the same driving waveform, denoted by $V_{saw/m}$ where m indicates that it is the $m^{th}$-row of the matrix which is being considered. When rows are addressed sequentially, the driving waveforms for the next row, denoted by $V_{saw/m+1}$, should incorporate a delay or phase shift of $T_{frame}/M$, where $T_{frame}$ is the frame period and M is the total number of rows in the matrix. Thus if the display is driven externally a total of M interconnections are required. This can be a problem for high resolution displays. Thus, according to one embodiment of the present invention there is provided an integrated waveform generator, by which the number of interconnections required can be reduced.

Figure 5:
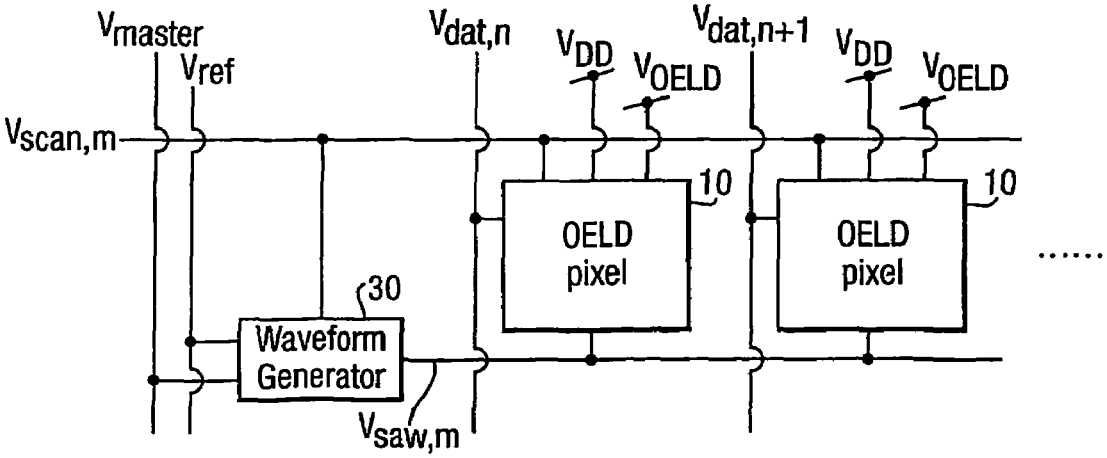
FIG. 5 is a circuit diagram illustrating the use of an integrated waveform generator.

FIG. 5 is a circuit diagram illustrating the use of an integrated waveform generator. The waveform generator 30 receives separate master and reference voltage inputs, $V_{master}$ and $V_{ref}$. The waveform generator 30 also receives an input from $V_{scan/m}$. The generator output $V_{saw/m}$ is applied to all of the pixels 10 in a particular row of the matrix.

Ideally, however, the function of the generators is to provide the same waveform with a unique phase shift for each row of pixel elements. The precise timing and data voltage relationship becomes a major challenge when the spatial variation of TFT characteristics over a display panel is taken into account. However, this problem can be solved by providing the master clock $V_{master}$ and the reference voltage source $V_{ref}$ to ensure that outputs from all waveform generators are the same but different in phase shift.

The waveform generator should be synchronised to $V_{scan/m}$, and thus the signal $V_{scan/m}$ can be used as a trigger.

Figure 6:
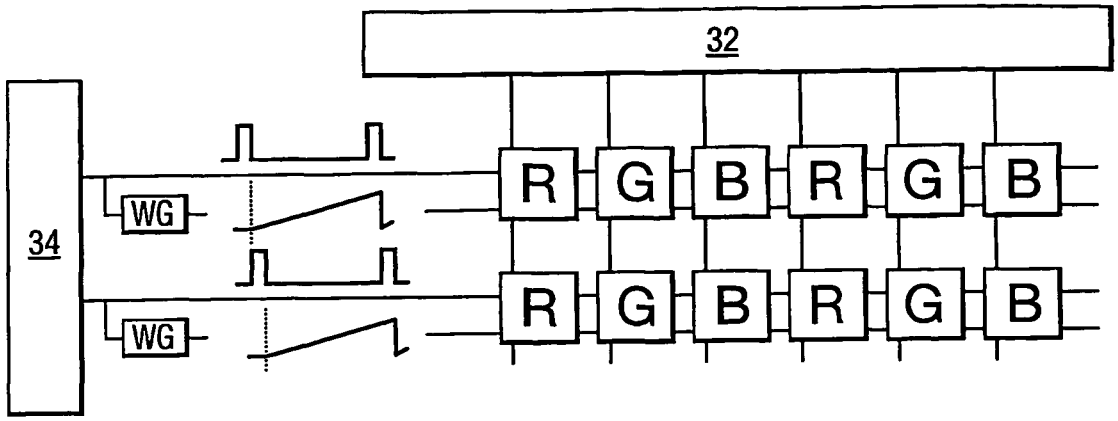
FIG. 6 illustrates a generalised synchronous driving scheme.

From the foregoing description, a generalised synchronous driving scheme is illustrated in FIG. 6. Two rows and six columns of pixels are illustrated. As denoted by R, G, B indicating red, green and blue; the light emitting element in each pixel may be designed to emit light of different colours thus implementing a full colour display. The pixels are driven by a data driver 32 and a row driver 34. A separate waveform generator, WG, is provided for each row and the signals applied are indicated in FIG. 6. Each waveform generator is synchronised to the scan line signal and the minimum operating frequency is equal to the frame rate.

Figure 7:
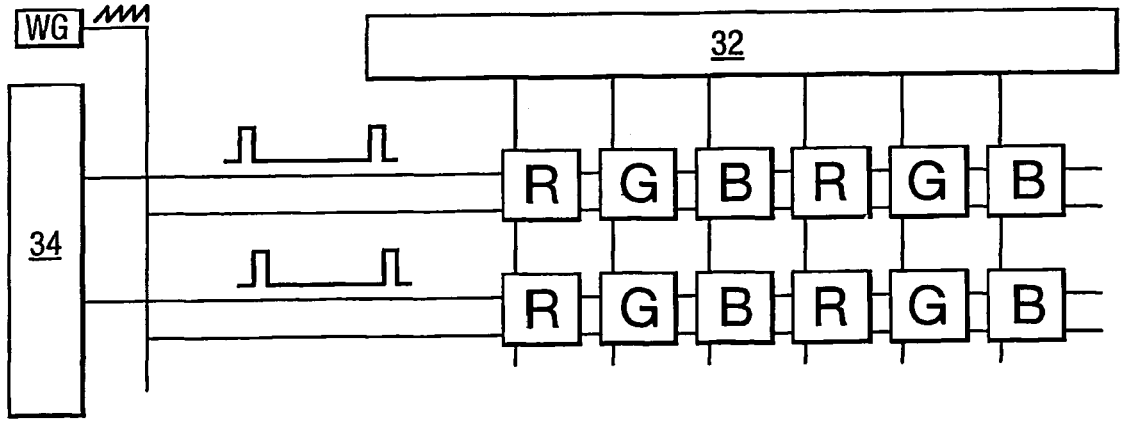
FIG. 7 illustrates a generalised asynchronous driving scheme.
Figure 8A:
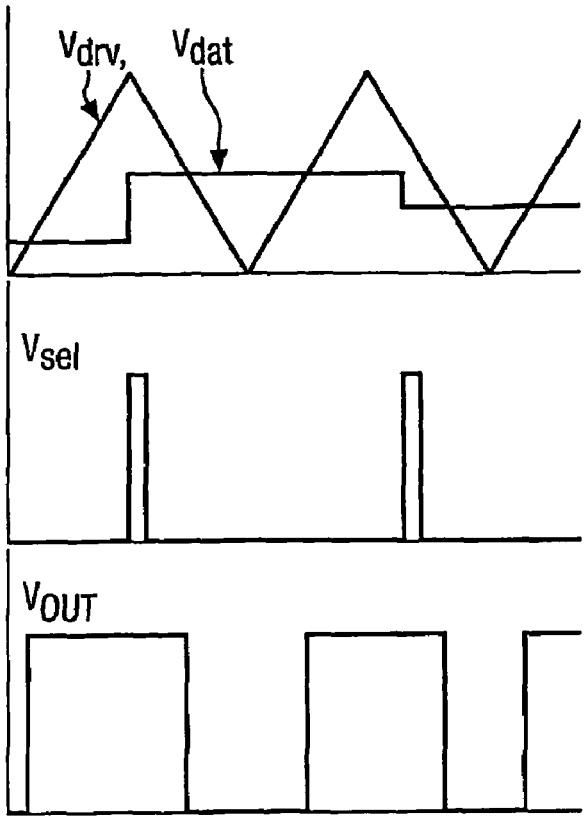
FIGS. 8A and 8B show the significance of using higher frequencies in the asynchronous driving scheme.
Figure 8B:
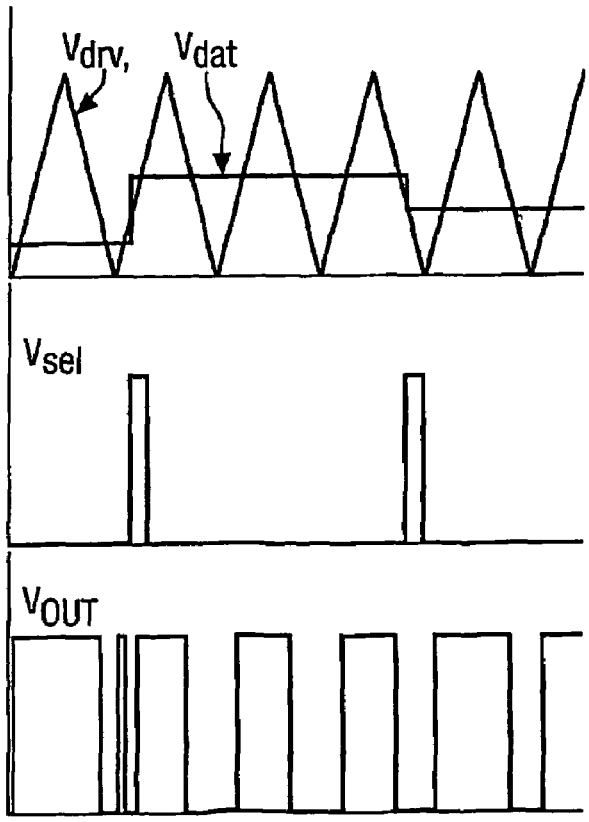

The display can also be driven asynchronously. An asynchronous driving scheme is shown in FIG. 7. The difference between this arrangement and that illustrated in FIG. 6 is that a single waveform generator is used for the whole display rather than using one per row. With this arrangement the waveform generator can be integrated on the display panel or can easily be provided externally of the panel. The waveform is independent of the scan line signal and higher operating frequencies can thus be used, thereby obtaining better image quality. The significance of using higher frequencies can be appreciated from FIGS. 8A and 8B, that is the improved gray scale accuracy of FIG. 8B (high frequency $V_{DRV}$) compared with FIG. 8A (low frequency $V_{DRV}$) is readily apparent. This phenomenon is important for moving images but can effectively be ignored for still images.

Figure 9A:
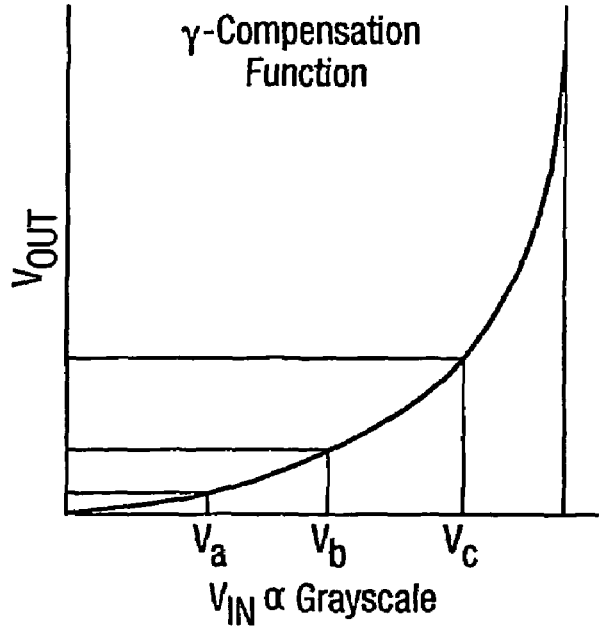
FIGS. 9A and 9B illustrate the incorporation of gamma correction in to the driving voltage.
Figure 9B:
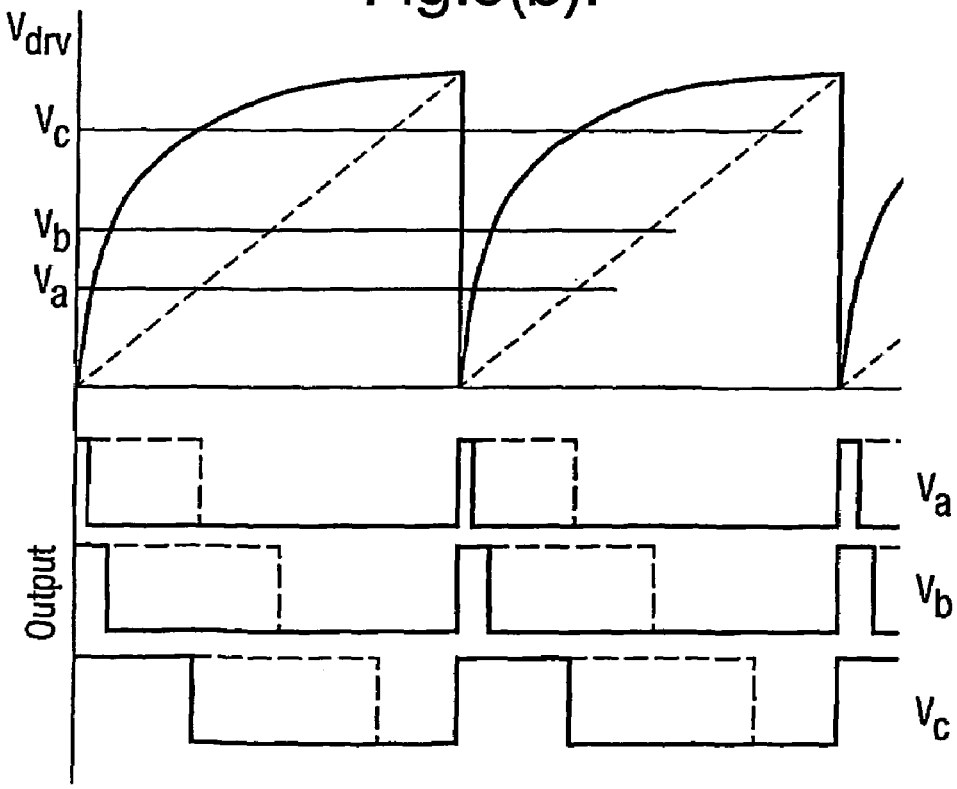

It is also possible to incorporate gamma compensation into the driving waveform. This is illustrated in FIGS. 9A and 9B, which show gamma correction incorporated in to the driving voltage $V_{DRV}$.

Figure 10:
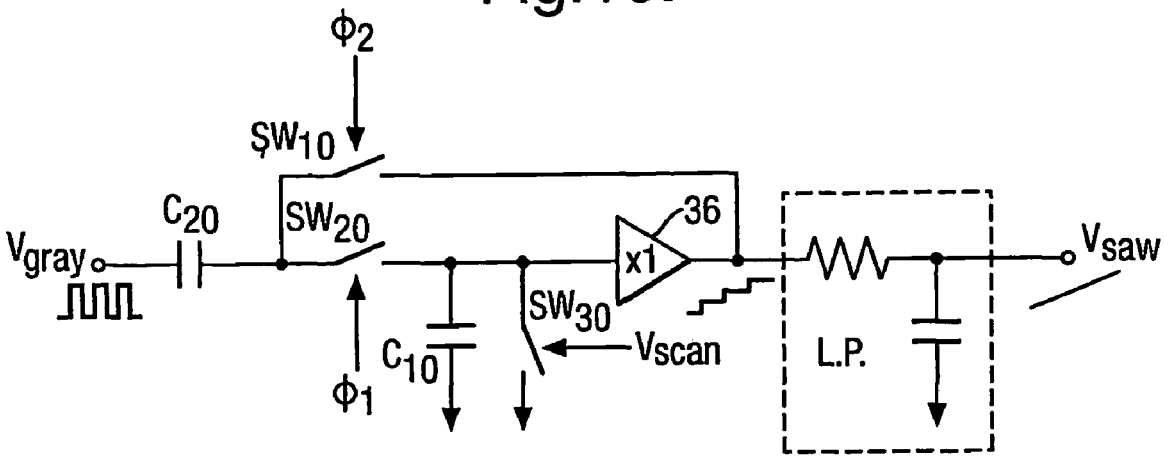
FIG. 10 is a detailed circuit diagram of a sawtooth wave generator.

FIG. 10 is a detailed circuit diagram of a sawtooth waveform generator such as may be employed in the above described embodiments of the present invention. The circuit receives an input signal $V_{gray}$ which is applied to one terminal of a capacitor $C_{20}$. The other terminal of capacitor $C_{20}$ is connected to one side of each of switches $SW_{10}$ and $SW_{20}$. These switches $SW_{10}$ and $SW_{20}$ are controlled by signals $\phi_1$ and $\phi_2$, respectively. The other side of switch $SW_{20}$ is connected to ground via a capacitor $C_{10}$ and also via a switch $SW_{30}$ which is controlled by signal $V_{scan}$. Switches $SW_{20}$, $SW_{30}$ and capacitor $C_{10}$ are connected to the input of a unity gain buffer 36. Switch $SW_{10}$ controls a feedback loop from the output of the buffer 36. The output of the buffer 36 is applied to a low-pass filter L.P. consisting of a resistor and a capacitor. The out put of the filter L.P. provides the generator output $V_{saw}$.

Figure 11:
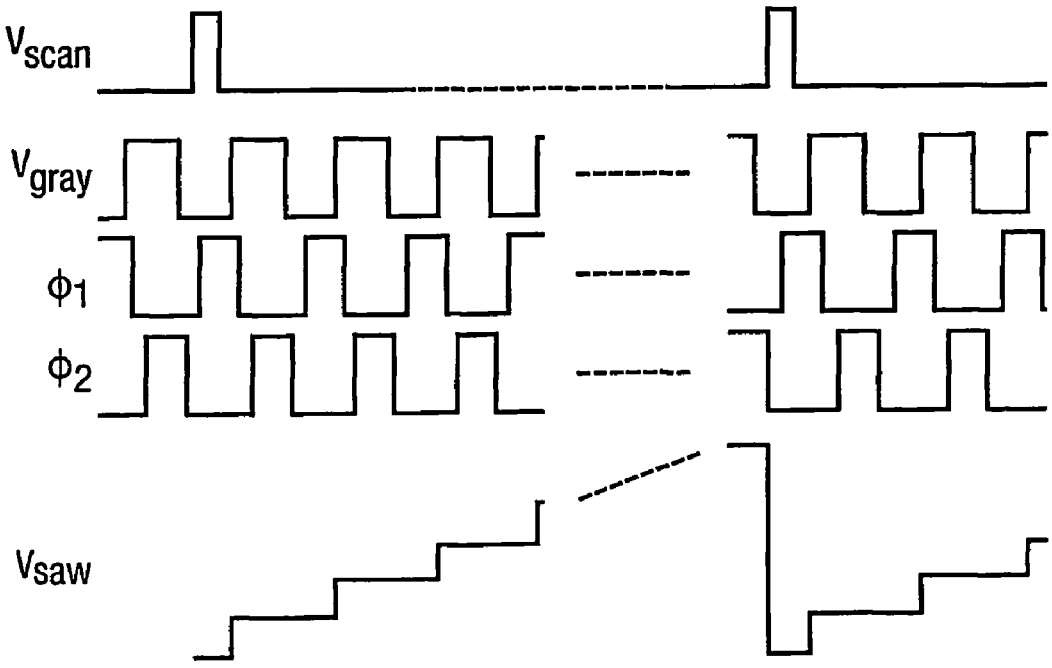
FIG. 11 shows input waveforms for the circuit of FIG. 10.

As noted above, the circuit has four inputs ($V_{gray}$, $\phi_1$, $\phi_2$ and $V_{scan}$) and one output ($V_{saw}$). The input waveforms are shown in FIG. 11.

Waveform $V_{gray}$ operates between 0V and a maximum level, say h. Waveforms $\phi_1$ and $\phi_2$ are non-overlapping clock pulses and $V_{scan}$ is the same signal as in the scan line. When $V_{scan}$ goes HI, data is transferred to the pixel storage capacitor as described above. At the same time, $V_{scan}$ signals $SW_{30}$ to close so that the input of the unity gain buffer is at 0V and $C_{10}$ is discharged. Effectively, this acts as a reset and zeros the output. When $V_{scan}$ goes LO, $SW_{30}$ is opened. Waveform $V_{gray}$=0V when $SW_{20}$ is closed and $SW_{10}$ is opened. The transition of $V_{gray}$ from 0V to h raises the input voltage at the unity gain buffer. If $C_{10}=C_{20}$, this increment equals h/2. When $V_{gray}$=h, $SW_{20}$ is opened and $SW_{10}$ is closed. The unity gain buffer 32 input voltage is stored by $C_{10}$. This voltage is reflected by the output of the unity gain buffer and is connected to $C_{20}$ while $V_{gray}$ returns to 0V. Next $SW_{10}$ is opened and then $SW_{20}$ is closed, and then $V_{gray}$ will transit from 0V to h. This will increase further the voltage at the input of the unity gain buffer 32. If $C_{10}=C_{20}$, this increment equals h/2 and the resulting voltage becomes h. This continues and the output of the unity gain buffer 36 takes on a step shape. If the output is passed through the low pass filter L.P. the output signal becomes a smooth ramp.

It may be appreciated that the described arrangements according to the present invention can utilise existing analog video signals as input signals.

EXAMPLE

An example was implemented using the circuits described above, with polysilicon TFTs. Using a data voltage range of 0V to 5V, 256 gray scales were implemented.

After the data transfer, which typically occurs in the first 20 μs, the frame period was divided into 256 sections. For a frame rate of 50 cycles/s, the time difference for each additional gray scale is given by $\Delta t=1/50\div256=78.125$ μs, and the corresponding data voltage difference is given by $\Delta V=5\div256=19.53$ mV. It is noted that for gray scale=0 the OELD must not be turned on at all.

Figure 12A:
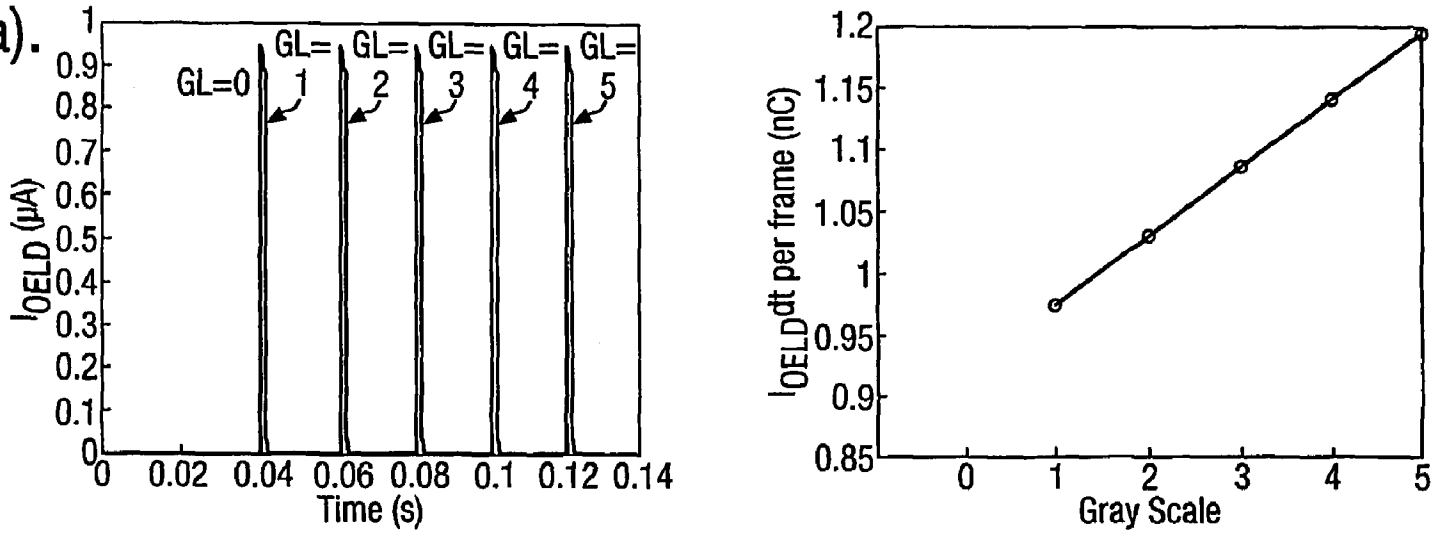
FIGS. 12A and 12B show gray scales obtained in a specific example.
Figure 12B:
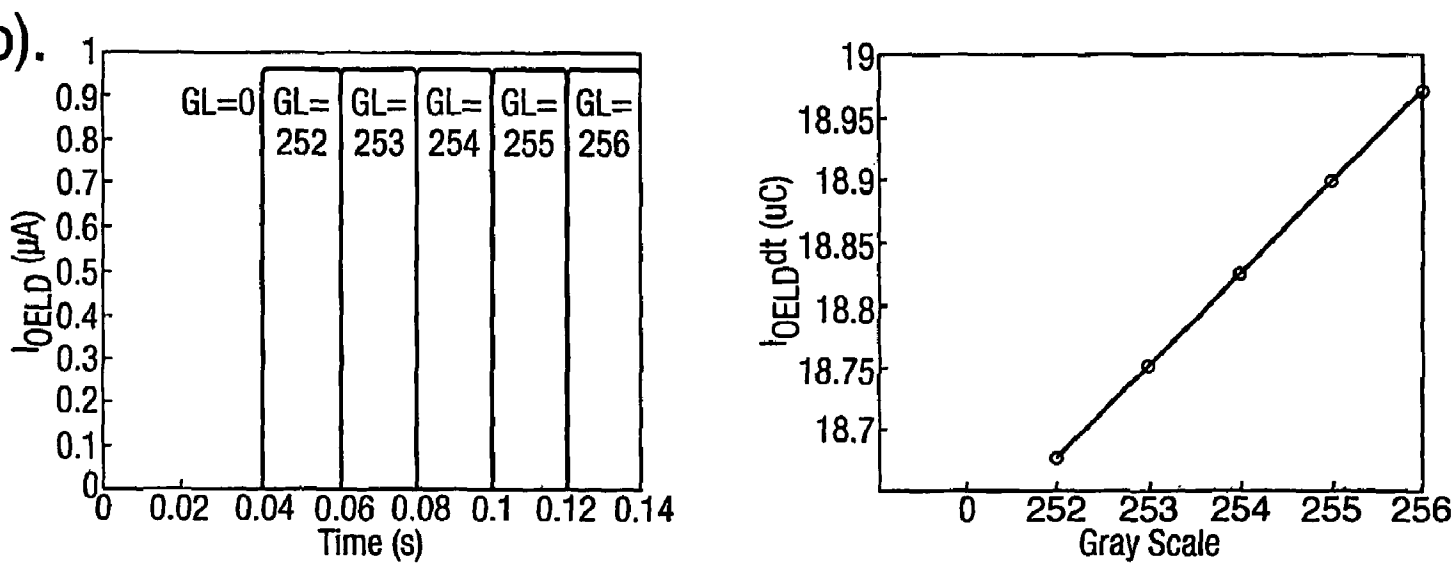

FIGS. 12A and 12B show the first five (GS=1 to 5) and last five (GS=252 to 256) gray scales, respectively. The area under the pulses are calculated and plotted against the gray scale. As shown in FIGS. 12A and 12B, there is good linearity of pixel brightness within the gray scaling. However, a difference in slope is noted. This is believed to be due to the round corner in the pulse trailing edges, caused by the circuit's stray capacitance. This results in a smaller change in brightness for the lower gray scale values. This is not a serious problem and can be corrected by adjusting the input signal.

The current required by the driver is small compared to the current flowing in to the electroluminescent element.

Generally, the image quality which can be achieved with the present invention has been found to be superior to conventional Liquid Crystal Displays and at least equal to that of conventional CRT displays. In addition, the low power consumption required by the display device of the present invention makes it ideal for mobile and portable apparatus.

Modifications

As will already be appreciated, although much of the detail given above in relation to specific embodiments has been in terms of organic electroluminescent display devices; the present invention is also applicable to other types of display devices. Further, althought the above described embodiments have mentioned specific implementation using TFT technology, usually in polysilicon,; the present invention is not limited to the use of TFT technology. The invention is applicable not only to thin film transistor technology but also to silicon based transistors. Silicon based transistors can be arranged on a display substrate using several different methods. For example, silicon based transistors can be arranged in a liquid.

The present invention is advantageous for use in small, mobile electronic products such as mobile phones, computers, CD players, DVD players and the like—although it is not limited thereto.

Several electronic apparatuses using a display device according to the present invention will now be described.

<1: Mobile Computer>

An example in which the display device according to one of the above embodiments is applied to a mobile personal computer will now be described.

FIG. 13 is an isometric view illustrating the configuration of this personal computer. In the drawing, the personal computer 1100 is provided with a body 1104 including a keyboard 1102 and a display unit 1106. The display unit 1106 is implemented using a display panel fabricated according to the present invention, as described above.

<2: Portable Phone>

Next, an example in which the display device is applied to a display section of a portable phone will be described. FIG. 14 is an isometric view illustrating the configuration of the portable phone. In the drawing, the portable phone 1200 is provided with a plurality of operation keys 1202, an earpiece 1204, a mouthpiece 1206, and a display panel 100. This display panel 100 is implemented using a display panel fabricated according to the present invention, as described above.

<3: Digital Still Camera>

Next, a digital still camera using an OEL display device as a finder will be described. FIG. 15 is an isometric view illustrating the configuration of the digital still camera and the connection to external devices in brief.

Typical cameras sensitize films based on optical images from objects, whereas the digital still camera 1300 generates imaging signals from the optical image of an object by photoelectric conversion using, for example, a charge coupled device (CCD). The digital still camera 1300 is provided with an OEL element 100 at the back face of a case 1302 to perform display based on the imaging signals from the CCD. Thus, the display panel 100 functions as a finder for displaying the object. A photo acceptance unit 1304 including optical lenses and the CCD is provided at the front side (behind in the drawing) of the case 1302.

When a cameraman determines the object image displayed in the OEL element panel 100 and releases the shutter, the image signals from the CCD are transmitted and stored to memories in a circuit board 1308. In the digital still camera 1300, video signal output terminals 1312 and input/output terminals 1314 for data communication are provided on a side of the case 1302. As shown in the drawing, a television monitor 1430 and a personal computer 1440 are connected to the video signal terminals 1312 and the input/output terminals 1314, respectively, if necessary. The imaging signals stored in the memories of the circuit board 1308 are output to the television monitor 1430 and the personal computer 1440, by a given operation.

Examples of electronic apparatuses, other than the personal computer shown in FIG. 13, the portable phone shown in FIG. 14, and the digital still camera shown in FIG. 15, include television sets, view-finder-type and monitoring-type video tape recorders, car navigation systems, pagers, electronic notebooks, portable calculators, word processors, workstations, TV telephones, point-of-sales system (POS) terminals, and devices provided with touch panels. Of course, the above described embodiments of the present invention can be applied to the display sections of these electronic apparatuses.

The invention claimed is:

1. A display device, comprising:

a plurality of scanning lines;

a plurality of data lines;

a plurality of time varying signal lines;

a plurality of pixels, each of which includes:

a first pass-gate that is controlled by one scanning line of the plurality of scanning lines;

a capacitor;

a second pass-gate that is connected to a common operating voltage; and a comparator that has a first input, a second input and an output, the first input and the second input being connected to the capacitor and one time varying signal line of the plurality of time varying signal lines, respectively, the capacitor storing a data signal supplied through the first pass-gate and one data line of the plurality of data lines, the comparator performing comparison of the data signal stored by the capacitor with a time varying signal supplied from the one time varying signal line and outputting an output signal on the basis of the comparison, the time varying signal incorporating a gamma correction;

the output signal being supplied to a gate of the second pass-gate, and the second pass-gate controlling a current supply from the common operating voltage according to the output signal.

2. The display device according to claim 1, the comparator being formed of thin film transistors.

3. The display device according to claim 2, the thin film transistors being formed of polysilicon.

4. The display device according to claim 1, the comparator including a differential amplifier and an inverter.

5. The display device according to claim 1, each of the plurality of pixels further including a light emitting element, and the second pass-gate controlling the current supply from the common operating voltage to the light emitting element.

6. The display device according to claim 5, the light emitting element being connected to the second pass-gate.

7. The display device according to claim 1, the second pass-gate being connected to a common operating voltage line whose voltage is set at the common operating voltage.

8. A driving method for a display device including a plurality of pixels, the driving method comprising:

supplying a data signal to a capacitor included in one pixel of the plurality of pixels through one data line of a plurality of data lines and a first pass-gate that is included in the pixel;

comparing the data signal stored by the capacitor to a time varying signal that incorporates a gamma correction and that is supplied through one time varying signal line of a plurality of time varying signal lines intersecting the plurality of data lines;

outputting an output signal that is obtained by the comparing of the data signal to the time varying signal to a second pass-gate included in the one pixel; and supplying a current to a light emitting element included in the one pixel through the second pass-gate from a common operating voltage according to the output signal.

9. The display device according to claim 1, a driving circuit supply voltage being supplied to the comparator.

10. The display device according to claim 1, further comprising:

a plurality of common operating voltage lines; and a plurality of driving circuit supply voltage lines, the second pass-gate being connected to one common operating voltage line of the plurality of common operating voltage lines whose voltages are set at the common operating voltage, and a driving circuit supply voltage being supplied to the comparator through one driving circuit supply voltage line of the plurality of driving circuit supply voltage lines.

11. A display device, comprising:

a plurality of scanning lines;

a plurality of data lines;

a plurality of time varying signal lines;

a plurality of pixels each of which includes:

a first transistor that is controlled by one scanning line of the plurality of scanning lines;

a capacitor;

a second transistor that is connected to a common operating voltage; and a comparator that has a first input, a second input and an output, the first input and the second output being connected to the capacitor and one time varying signal line of the plurality of time varying signal lines, respectively, the capacitor storing a data signal supplied through the first transistor and one data line of the plurality of data lines, the comparator performing comparison of the data signal stored by the capacitor with a time varying signal supplied from the one time varying signal line and outputting an output signal on the basis of the comparison, the time varying signal incorporating a gamma correction;

the output signal being supplied to a gate of the second transistor, and the second transistor controlling a current supply from the common operating voltage according to the output signal.

12. The display device according to claim 11, the plurality of time varying signal lines intersecting the plurality of data lines.

13. The display device according to claim 1, the plurality of time varying signal lines intersecting the plurality of data lines.

14. The display device according to claim 11, further comprising:

a plurality of common operating voltage lines; and a plurality of driving circuit supply voltage lines, the second pass-gate being connected to one common operating voltage line of the plurality of common operating voltage lines whose voltages are set at the common operating voltage, and a driving circuit supply voltage being supplied to the comparator through one driving circuit supply voltage line of the plurality of driving circuit supply voltage lines.

15. The display device according to claim 11, further comprising:

a waveform generator that provides a plurality of time varying signals through the plurality of time varying signal lines each of which is generated by performing a phase shift.

16. The display device according to claim 1, further comprising:

a waveform generator that provides a plurality of time varying signals through the plurality of time varying signal lines each of which is generated by performing a phase shift.

17. A display device comprising:

a plurality of scanning lines;

a plurality of data lines;

a plurality of pixels each of which includes a light emitting element and a capacitor storing a data signal supplied through one data line of the plurality of data lines;

a comparison of the data signal stored by the capacitor with a time varying signal that incorporates a gamma correction being carried out; and a length of the period in which the light emitting element emits a light depending on the result of the comparison.

18. The display device according to claim 17, each of the plurality of pixels further including a comparator that performs the comparison.

19. The display device according to claim 17, further comprising a plurality of time varying signal lines, the time varying signal being supplied through one time varying signal line of the plurality of time varying signal lines.

20. The display device according to claim 18, each of the plurality of pixels further including a pass-gate that controls a current supply from a common operating voltage according to the result of the comparison, and the comparator outputting an output signal that is supplied to a gate of the pass-gate.

* * * * *